US008843043B2

(12) United States Patent
Iwaya et al.

(10) Patent No.: US 8,843,043 B2
(45) Date of Patent: Sep. 23, 2014

(54) FIXING DEVICE AND IMAGE FORMING APPARATUS INCORPORATING SAME

(75) Inventors: Naoki Iwaya, Tokyo (JP); Masaaki Yoshikawa, Tokyo (JP); Akira Shinshi, Tokyo (JP); Kenji Ishii, Kanagawa (JP); Kenichi Hasegawa, Kanagawa (JP); Hiroshi Yoshinaga, Chiba (JP); Yoshiki Yamaguchi, Kanagawa (JP); Yutaka Ikebuchi, Kanagawa (JP); Ippei Fujimoto, Kanagawa (JP); Shuntaroh Tamaki, Kanagawa (JP); Toshihiko Shimokawa, Kanagawa (JP); Tetsuo Tokuda, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

(21) Appl. No.: 12/964,090

(22) Filed: Dec. 9, 2010

(65) Prior Publication Data

US 2011/0211876 A1 Sep. 1, 2011

(30) Foreign Application Priority Data

Feb. 26, 2010 (JP) ..... 2010-041952

(51) Int. Cl.
*G03G 15/20* (2006.01)

(52) U.S. Cl.
CPC .... *G03G 15/2085* (2013.01); *G03G 2221/1672* (2013.01); *G03G 2215/2035* (2013.01)
USPC ..... 399/329

(58) Field of Classification Search
USPC ..... 399/323, 329
See application file for complete search history.

(56) References Cited

U.S. PATENT DOCUMENTS

| | | | | |
|---|---|---|---|---|
| 5,525,775 | A * | 6/1996 | Setoriyama et al. | 219/216 |
| 2006/0133868 | A1 * | 6/2006 | Kobayashi et al. | 399/328 |
| 2007/0292175 | A1 | 12/2007 | Shinshi | |
| 2008/0112739 | A1 | 5/2008 | Shinshi | |

(Continued)

FOREIGN PATENT DOCUMENTS

| | | |
|---|---|---|
| CN | 101995802 A | 3/2011 |
| JP | 2884714 | 2/1999 |

(Continued)

OTHER PUBLICATIONS

Machine translation of Murakami et al., JP 2004-294735, Part 1.*

(Continued)

*Primary Examiner* — David Gray
*Assistant Examiner* — Sevan A Aydin
(74) *Attorney, Agent, or Firm* — Oblon, Spivak, McClelland, Maier & Neustadt, L.L.P.

(57) ABSTRACT

A fixing device includes a flexible, endless belt-shaped fixing member that rotates in a predetermined direction of rotation, a substantially cylindrical metal heat conductor provided inside a loop formed by the fixing member and facing an inner circumferential surface of the fixing member, a pressing member that presses the fixing member against the metal heat conductor to form a nip between the fixing member and the pressing member through which a recording medium bearing a toner image passes, and a separator that presses the fixing member against the metal heat conductor, provided downstream from the nip in the direction of rotation of the fixing member and contacting the recording medium discharged from the nip to separate the recording medium from the fixing member and guide the recording medium out of the fixing device.

11 Claims, 6 Drawing Sheets

(56) References Cited

U.S. PATENT DOCUMENTS

| | | | | |
|---|---|---|---|---|
| 2008/0175633 | A1 | 7/2008 | Shinshi | |
| 2008/0219730 | A1 | 9/2008 | Shinshi | |
| 2008/0298862 | A1 * | 12/2008 | Shinshi | 399/324 |
| 2009/0311016 | A1 | 12/2009 | Shinshi | |
| 2010/0092220 | A1 | 4/2010 | Hasegawa et al. | |
| 2010/0092221 | A1 | 4/2010 | Shinshi et al. | |
| 2010/0202809 | A1 | 8/2010 | Shinshi et al. | |
| 2010/0290822 | A1 | 11/2010 | Hasegawa et al. | |

FOREIGN PATENT DOCUMENTS

| | | | | |
|---|---|---|---|---|
| JP | 3298354 | | 4/2002 | |
| JP | 2004294735 | A * | 10/2004 | G03G 9/087 |
| JP | 2005-173447 | A | 6/2005 | |
| JP | 2006-235006 | | 9/2006 | |
| JP | 2007-178462 | A | 7/2007 | |
| JP | 2007-334205 | | 12/2007 | |
| JP | 2009-3410 | | 1/2009 | |

OTHER PUBLICATIONS

Machine translation of Murakami et al., JP 2004-294735, Part 2.*
Merriam-Websters's Collegiate Dictionary, 10th Ed., p. 986 (1998).*
U.S. Appl. No. 12/823,770, filed Jun. 25, 2010, Kenichi Hasegawa.
U.S. Appl. No. 12/841,593, filed Jul. 22, 2010, Masaaki Yoshikawa et al.
U.S. Appl. No. 12/805,818, filed Aug. 20, 2010, Unknown.
U.S. Appl. No. 12/876,589, filed Sep. 7, 2010, Yoshiki Yamaguchi et al.
U.S. Appl. No. 12/879,875, filed Sep. 10, 2010, Ippei Fujimoto et al.
U.S. Appl. No. 12/852,079, filed Aug. 6, 2010, Akira Shinshi et al.
U.S. Appl. No. 12/923,272, filed Sep. 13, 2010, Unknown.
U.S. Appl. No. 12/881,862, filed Sep. 14, 2010, Takamasa Hase et al.
U.S. Appl. No. 12/888,980, filed Sep. 23, 2010, Yoshiki Yamaguchi et al.
U.S. Appl. No. 12/923,231, filed Sep. 10, 2010, Unknown.
U.S. Appl. No. 12/923,176, filed Sep. 8, 2010, Unknown.
U.S. Appl. No. 12/874,734, filed Sep. 2, 2010, Akira Shinshi et al.
U.S. Appl. No. 12/861,255, filed Aug. 23, 2010, Satoshi Ueno et al.
U.S. Appl. No. 12/881,547, filed Sep. 14, 2010, Naoki Iwaya et al.
U.S. Appl. No. 12/849,404, filed Aug. 3, 2010, Toshihiko Shimokawa et al.
U.S. Appl. No. 12/878,480, filed Sep. 9, 2010, Yoshiki Yamaguchi et al.
U.S. Appl. No. 12/880,327, filed Sep. 13, 2010, Ryota Yamashina et al.
U.S. Appl. No. 12/857,953, filed Aug. 17, 2010, Masaaki Yoshikawa et al.
U.S. Appl. No. 12/893,361, filed Sep. 29, 2010, Kenichi Hasegawa et al.
U.S. Appl. No. 12/878,557, filed Sep. 9, 2010, Akira Shinshi et al.
U.S. Appl. No. 12/946,276, filed Nov. 15, 2010, Yoshiki Yamaguchi et al.
U.S. Appl. No. 12/946,347, filed Nov. 15, 2010, Kenji Ishii et al.
Chinese Office Action Issued Oct. 25, 2012 in Patent Application No. 201110038736.4.

* cited by examiner

FIXING DEVICE AND IMAGE FORMING APPARATUS INCORPORATING SAME

CROSS-REFERENCE TO RELATED APPLICATIONS

The present application is based on and claims priority to Japanese Patent Application No. 2010-041952, filed on Feb. 26, 2010, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

The fixing device used in such image forming apparatuses may include a fixing belt to apply heat to the recording medium bearing the toner image. FIG. 1 is a sectional view of a fixing device 50R1 including a fixing belt 25. As illustrated in FIG. 1, the fixing belt 25 is looped over a heating roller 22 (inside which a heater 21 is provided) and a fixing roller 23, in a state in which a tension roller 24 biased by a spring applies tension to the fixing belt 25. A pressing roller 26 is disposed opposite the fixing roller 23 via the fixing belt 25 and presses the fixing belt 25 against the fixing roller 23 to form a fixing nip between the pressing roller 26 and the fixing belt 25. As a recording medium P bearing a toner image passes through the fixing nip, the fixing belt 25 heated by the heater 21 via the heating roller 22 and the pressing roller 26 apply heat and pressure to the recording medium P to fix the toner image on the recording medium P.

In order to provide a shortened warm-up time and reduced power consumption compared to the fixing device 50R1 using the fixing belt 25, the fixing device may instead employ a fixing film formed into a loop and having a smaller heat capacity than the fixing belt 25. FIG. 2 is a sectional view of a fixing device 50R2 including a fixing film 14. As illustrated in FIG. 2, a ceramic heater 13 supported by a stay 12 via a holder 11 is provided inside the loop formed by the fixing film 14. A pressing roller 16 presses the fixing film 14 against the ceramic heater 13 to form a fixing nip between the pressing roller 16 and the fixing film 14. As a recording medium bearing a toner image passes through the fixing nip, the ceramic heater 13 applies heat to the recording medium via the fixing film 14 and simultaneously the pressing roller 16 applies pressure to the recording medium. Thus, the heat and the pressure fix the toner image on the recording medium.

With the fixing film 14 having a smaller heat capacity than the fixing belt 25, the fixing device 50R2 can be heated to a predetermined fixing temperature by turning on the ceramic heater 13 immediately before an image forming operation is started. Thus, the fixing device 50R2 is warmed up quickly while at the same time reducing power consumption.

However, the fixing device 50R2 using the fixing film 14 has a drawback in that the fixing film 14 may wear due to friction generated between the stationary ceramic heater 13 and the rotating fixing film 14 that slides over the ceramic heater 13. Accordingly, the worn fixing film 14 with a roughened inner circumferential surface may increase friction between the fixing film 14 and the ceramic heater 13, resulting in unstable rotation of the fixing film 14 and increased driving torque of the fixing device 50R2. The fixing device 50R2 also has a drawback in that the fixing film 14 is heated by the ceramic heater 13 only at the fixing nip, and therefore the fixing film 14 is coolest when entering the fixing nip. Accordingly, when the fixing film 14 is rotated at a high speed, the fixing film 14 may not have been heated to a desired fixing temperature by the time the fixing film 14 enters the fixing nip and contacts the recording medium there.

To address these problems, the fixing device may instead employ a combination of a looped fixing belt and a cylindrical metal heat conductor instead of the fixing film 14 and the ceramic heater 13. For example, the metal heat conductor fixedly mounted inside the looped fixing belt receives heat from a heater provided inside the cylindrical metal heat conductor, and then transmits the heat to the fixing belt. A pressing roller presses the fixing belt against the metal heat conductor to form a fixing nip between the pressing roller and the fixing belt through which the recording medium bearing the toner image passes. With this configuration, the entire fixing belt is heated by the metal heat conductor, which faces substantially the entire portion of the fixing belt as the rotating fixing belt slides over the metal heat conductor. Further, the inner diameter of the fixing belt is set greater than the outer diameter of the metal heat conductor to reduce friction between the metal heat conductor and the fixing belt.

However, the fixing belt and the metal heat conductor have a drawback in that the fixing belt may slacken at a position downstream from the fixing nip in the direction of rotation of the fixing belt. Specifically, the rotating pressing roller pulls the upstream portion of the fixing belt provided upstream from the fixing nip in the direction of rotation of the fixing belt to the fixing nip in such a manner that the upstream portion of the fixing belt is stretched over the metal heat conductor. By contrast, the rotating pressing roller does not stretch the downstream portion of the fixing belt provided downstream from the fixing nip in the direction of rotation of the fixing belt, slackening the downstream portion of the fixing belt. Accordingly, the slackened fixing belt heated by the metal heat conductor contacts the recording medium bearing the fixed toner image at the position downstream from the fixing nip in the direction of rotation of the fixing belt for a longer time, and therefore heats the recording medium excessively, causing hot offset of the toner image fixed on the recording medium. Moreover, the slackened fixing belt disturbs separation of the recording medium discharged from the fixing nip from the fixing belt, causing jamming of the recording medium.

BRIEF SUMMARY OF THE INVENTION

This specification describes below an improved fixing device. In one exemplary embodiment of the present invention, the fixing device includes a flexible, endless belt-shaped fixing member, a substantially cylindrical metal heat conductor, a pressing member, and a separator. The flexible, endless belt-shaped fixing member rotates in a predetermined direction of rotation, and is formed into a loop. The substantially cylindrical metal heat conductor is provided inside the loop formed by the fixing member and faces an inner circumferential surface of the fixing member. The pressing member presses the fixing member against the metal heat conductor to form a nip between the fixing member and the pressing member through which a recording medium bearing a toner image passes. The separator, which presses the fixing member against the metal heat conductor, is provided downstream from the nip in the direction of rotation of the fixing member and contacts the recording medium discharged from the nip to separate the recording medium from the fixing member and guide the recording medium out of the fixing device.

This specification further describes an image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
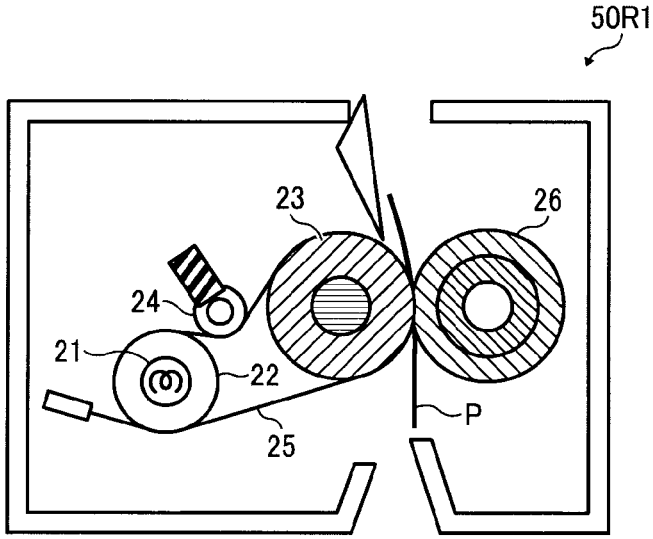
FIG. 1 RELATED ART
FIG. 1 is a sectional view of one related-art fixing device.
Figure 2:
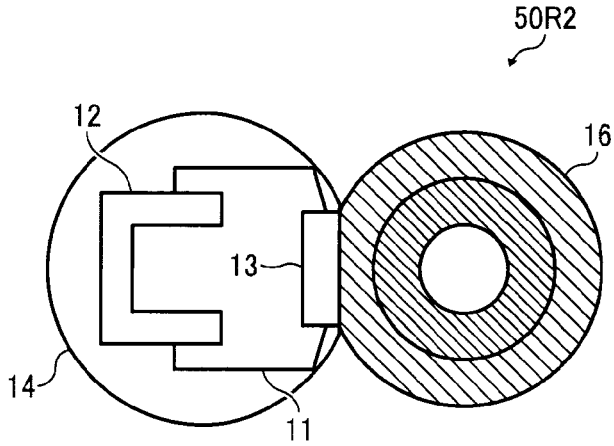
FIG. 2 RELATED ART
FIG. 2 is a sectional view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 3:
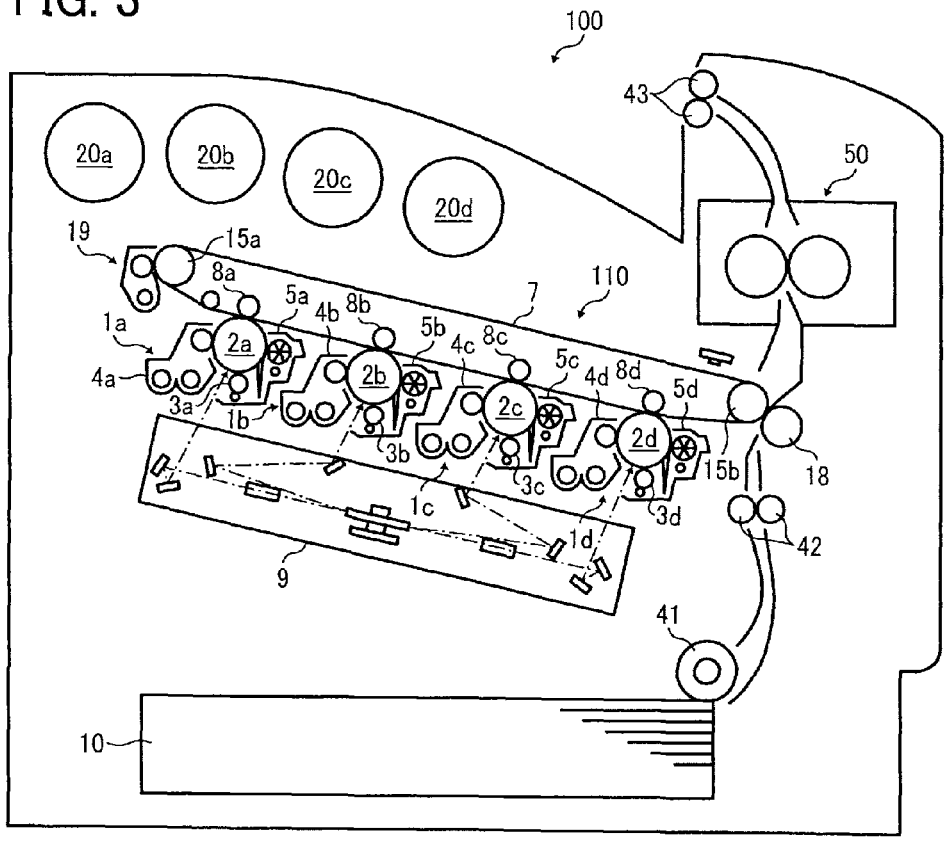
FIG. 3 is a schematic view of an image forming apparatus according to an exemplary embodiment of the present invention.

Referring now to the drawings, wherein like reference numerals designate identical or corresponding parts throughout the several views, in particular to FIG. 3, an image forming apparatus 100 according to an exemplary embodiment of the present invention is explained.

FIG. 3 is a schematic view of the image forming apparatus 100. As illustrated in FIG. 3, the image forming apparatus 100 may be a copier, a facsimile machine, a printer, a multifunction printer having at least one of copying, printing, scanning, plotter, and facsimile functions, or the like. According to this exemplary embodiment of the present invention, the image forming apparatus 100 is a color printer for forming a color image on a recording medium by electrophotography.

As illustrated in FIG. 3, the image forming apparatus 100 includes an image forming portion 110 provided in a center portion of the image forming apparatus 100, an exposure device 9 provided below the image forming portion 110, toner bottles 20*a*, 20*b*, 20*c*, and 20*d* provided above the image forming portion 110, a paper tray 10 provided below the exposure device 9 in a lower portion of the image forming apparatus 100, a feed roller 41 provided above the paper tray 10, a registration roller pair 42 provided above the feed roller 41, a fixing device 50 provided above the image forming portion 110, and an output roller pair 43 provided above the fixing device 50 in an upper portion of the image forming apparatus 100.

The image forming portion 110 forms a toner image on a recording medium by electrophotography and includes image forming devices 1*a*, 1*b*, 1*c*, and 1*d*, an intermediate transfer belt 7, first transfer rollers 8*a*, 8*b*, 8*c*, and 8*d*, support rollers 15*a* and 15*b*, a second transfer roller 18, and a belt cleaner 19.

The four image forming devices 1*a*, 1*b*, 1*c*, and 1*d* have an identical structure but use toners in colors different from each other, for example, black, magenta, cyan, and yellow toners to form black, magenta, cyan, and yellow toner images, respectively.

The image forming devices 1*a*, 1*b*, 1*c*, and 1*d* include photoconductors 2*a*, 2*b*, 2*c*, and 2*d*, chargers 3*a*, 3*b*, 3*c*, and 3*d*, development devices 4*a*, 4*b*, 4*c*, and 4*d*, and cleaners 5*a*, 5*b*, 5*c*, and 5*d*, respectively.

The photoconductors 2*a*, 2*b*, 2*c*, and 2*d* serving as electrostatic latent image carriers having a drum shape are surrounded by the chargers 3*a*, 3*b*, 3*c*, and 3*d*, the development devices 4*a*, 4*b*, 4*c*, and 4*d*, and the cleaners 5*a*, 5*b*, 5*c*, and 5*d*, respectively. The photoconductors 2*a*, 2*b*, 2*c*, and 2*d* rotate clockwise in FIG. 3. The chargers 3*a*, 3*b*, 3*c*, and 3*d* contact outer circumferential surfaces of the photoconductors 2*a*, 2*b*, 2*c*, and 2*d*, respectively. The chargers 3*a*, 3*b*, 3*c*, and 3*d* rotate in accordance with rotation of the photoconductors 2*a*, 2*b*, 2*c*, and 2*d*, respectively. A high-voltage power source applies a predetermined bias voltage to the chargers 3*a*, 3*b*, 3*c*, and 3*d* to uniformly charge the surfaces of the rotating photoconductors 2*a*, 2*b*, 2*c*, and 2*d*. Each of the chargers 3*a*, 3*b*, 3*c*, and 3*d* includes a roller that contacts the surface of each of the photoconductors 2*a*, 2*b*, 2*c*, and 2*d*. Alternatively, the chargers 3*a*, 3*b*, 3*c*, and 3*d* may be non-contact chargers that charge the surfaces of the photoconductors 2*a*, 2*b*, 2*c*, and 2*d* by corona charging without contacting the photoconductors 2*a*, 2*b*, 2*c*, and 2*d*.

The exposure device 9 is disposed diagonally with respect to a horizontal plane below the four image forming devices 1*a*, 1*b*, 1*c*, and 1*d* in such a manner that the exposure device 9 is disposed parallel to the four image forming devices 1*a*, 1*b*, 1*c*, and 1*d*. The exposure device 9 includes optical units including a light source, a polygon mirror, fθ lenses, and reflection mirrors, and exposes the photoconductors 2*a*, 2*b*, 2*c*, and 2*d* charged by the chargers 3*a*, 3*b*, 3*c*, and 3*d* according to black, magenta, cyan, and yellow image data sent from a client computer, for example, to form electrostatic latent images corresponding to the black, magenta, cyan, and yellow image data on the photoconductors 2*a*, 2*b*, 2*c*, and 2*d*, respectively.

As the electrostatic latent images formed on the photoconductors 2*a*, 2*b*, 2*c*, and 2*d* pass through the development devices 4*a*, 4*b*, 4*c*, and 4*d* in accordance with rotation of the photoconductors 2*a*, 2*b*, 2*c*, and 2*d*, the development devices 4*a*, 4*b*, 4*c*, and 4*d* supply black, magenta, cyan, and yellow toners to the electrostatic latent images formed on the photoconductors 2*a*, 2*b*, 2*c*, and 2*d* to make the electrostatic latent images visible as black, magenta, cyan, and yellow toner images, respectively.

The toner bottles 20*a*, 20*b*, 20*c*, and 20*d* are provided in the upper portion of the image forming apparatus 100, and contain black, magenta, cyan, and yellow toners to be supplied to the development devices 4*a*, 4*b*, 4*c*, and 4*d* through conveyance paths, respectively.

The intermediate transfer belt 7 serving as an intermediate transfer member having an endless belt shape is disposed opposite the photoconductors 2*a*, 2*b*, 2*c*, and 2*d* in such a manner that the photoconductors 2*a*, 2*b*, 2*c*, and 2*d* contact an outer circumferential surface of the intermediate transfer belt 7. The intermediate transfer belt 7 is looped over a plurality of support rollers, that is, the support rollers 15*a* and 15*b*. For example, the support roller 15*a* is connected to a driving motor serving as a driver. When the driving motor is driven, the driving motor drives and rotates the support roller 15*a*, so that the rotating support roller 15*a* rotates the intermediate transfer belt 7 counterclockwise in FIG. 3. Accordingly, the rotating intermediate transfer belt 7 rotates the support roller 15*b* serving as a driven roller.

The first transfer rollers 8*a*, 8*b*, 8*c*, and 8*d* face an inner circumferential surface of the intermediate transfer belt 7, and are disposed opposite the photoconductors 2*a*, 2*b*, 2*c*, and 2*d* via the intermediate transfer belt 7. A high-voltage power source applies a first transfer bias to the first transfer rollers 8*a*, 8*b*, 8*c*, and 8*d* to primarily transfer the black, magenta, cyan, and yellow toner images formed on the photoconductors 2*a*, 2*b*, 2*c*, and 2*d* onto the outer circumferential surface of the intermediate transfer belt 7 to form a color toner image on the intermediate transfer belt 7.

After the transfer of the black, magenta, cyan, and yellow toner images, the cleaners 5*a*, 5*b*, 5*c*, and 5*d* remove residual black, magenta, cyan, and yellow toners not transferred and therefore remaining on the photoconductors 2*a*, 2*b*, 2*c*, and 2*d* from the photoconductors 2*a*, 2*b*, 2*c*, and 2*d*, respectively. Thus, the photoconductors 2*a*, 2*b*, 2*c*, and 2*d* become ready for a next image forming operation.

The second transfer roller 18 serving as a second transfer member is provided downstream from the first transfer rollers 8*a*, 8*b*, 8*c*, and 8*d* in a rotation direction of the intermediate transfer belt 7. The second transfer roller 18 is disposed opposite the support roller 15*b* via the intermediate transfer belt 7 in such a manner that the second transfer roller 18 and the support roller 15*b* form a second transfer nip therebetween via the intermediate transfer belt 7 at which the color toner image formed on the intermediate transfer belt 7 is secondarily transferred onto a recording medium.

The paper tray 10 loads recording media to be conveyed to the second transfer nip by the feed roller 41 and the registration roller pair 42. The fixing device 50 is provided downstream from the second transfer roller 18 in a recording medium conveyance direction, and applies heat and pressure to the recording medium bearing the toner image which is sent from the second transfer nip to fix the toner image on the recording medium. The output roller pair 43 is provided downstream from the fixing device 50 in the recording medium conveyance direction, and discharges the recording medium bearing the fixed toner image which is sent from the fixing device 50 onto an output tray provided atop the image forming apparatus 100 to receive and stack the recording medium discharged by the output roller pair 43.

The following describes image forming processes performed by the image forming apparatus 100.

When the image forming apparatus 100 receives an image forming signal from an external device such as a client computer, a driver drives and rotates the photoconductors 2*a*, 2*b*, 2*c*, and 2*d* clockwise in FIG. 3, and dischargers disposed opposite the photoconductors 2*a*, 2*b*, 2*c*, and 2*d* emit light onto the surfaces of the photoconductors 2*a*, 2*b*, 2*c*, and 2*d* to initialize potential of the surfaces of the photoconductors 2*a*, 2*b*, 2*c*, and 2*d*.

Thereafter, the chargers 3*a*, 3*b*, 3*c*, and 3*d* uniformly charge the surfaces of the photoconductors 2*a*, 2*b*, 2*c*, and 2*d* having the initialized potential to have a predetermined polarity. The exposure device 9 emits laser beams onto the charged surfaces of the photoconductors 2*a*, 2*b*, 2*c*, and 2*d* according to black, magenta, cyan, and yellow image data sent from the external device to form desired electrostatic latent images on the surfaces of the photoconductors 2*a*, 2*b*, 2*c*, and 2*d*. The black, magenta, cyan, and yellow image data are obtained by separating desired full-color image data into image data corresponding to black, magenta, cyan, and yellow colors. As the electrostatic latent images formed on the photoconductors 2*a*, 2*b*, 2*c*, and 2*d* pass through the development devices 4*a*, 4*b*, 4*c*, and 4*d*, the development devices 4*a*, 4*b*, 4*c*, and 4*d* supply developer, that is, black, magenta, cyan, and yellow toners, to the electrostatic latent images to make the electrostatic latent images visible as black, magenta, cyan, and yellow toner images, respectively.

The intermediate transfer belt 7 rotates counterclockwise in FIG. 3. The first transfer rollers 8*a*, 8*b*, 8*c*, and 8*d* are applied with a first transfer voltage having a polarity opposite a polarity of the black, magenta, cyan, and yellow toner images formed on the photoconductors 2*a*, 2*b*, 2*c*, and 2*d*, respectively. Accordingly, the first transfer voltage generates a first transfer electric field between the photoconductors 2*a*, 2*b*, 2*c*, and 2*d* and the intermediate transfer belt 7, which primarily transfers the black, magenta, cyan, and yellow toner images formed on the photoconductors 2*a*, 2*b*, 2*c*, and 2*d* electrostatically onto the intermediate transfer belt 7 rotating in synchronism with rotation of the photoconductors 2*a*, 2*b*, 2*c*, and 2*d*. Specifically, the black, magenta, cyan, and yellow toner images formed on the photoconductors 2*a*, 2*b*, 2*c*, and 2*d* are transferred onto the intermediate transfer belt 7 at different times in the order of from the photoconductor 2*a* provided upstream in the rotation direction of the intermediate transfer belt 7 to the photoconductor 2*d* provided downstream in the rotation direction of the intermediate transfer belt 7. Accordingly, the black, magenta, cyan, and yellow toner images are superimposed onto a same position on the intermediate transfer belt 7, thus forming a desired full-color toner image on the intermediate transfer belt 7.

On the other hand, the feed roller 41 picks up and feeds an uppermost recording medium of recording media loaded on the paper tray 10 toward the registration roller pair 42. Specifically, the feed roller 41 separates the uppermost recording medium from other recording media loaded on the paper tray 10, and conveys the uppermost recording medium to a nip formed between two rollers of the registration roller pair 42 which stops rotating temporarily. For example, a leading edge of the uppermost recording medium contacts the nip formed between the two rollers of the registration roller pair 42 and the recording medium is formed into a loop for its registration.

Thereafter, the registration roller pair 42 resumes rotating, and sends the recording medium toward the second transfer nip formed between the second transfer roller 18 and the support roller 15*b* via the intermediate transfer belt 7 at a proper time at which the recording medium contacts the full-color toner image formed on the intermediate transfer belt 7.

According to this exemplary embodiment, the second transfer roller 18 is applied with a transfer bias having a polarity opposite a polarity of the full-color toner image formed on the intermediate transfer belt 7 to transfer the full-color toner image onto the recording medium. Thus, the recording medium carries the unfixed toner image, and is conveyed to the fixing device 50. After the transfer of the full-color toner image onto the recording medium, the belt cleaner 19 removes and collects residual toner not transferred and therefore remaining on the intermediate transfer belt 7 from the intermediate transfer belt 7.

As the recording medium bearing the unfixed toner image passes through the fixing device 50, the fixing device 50 applies heat and pressure to the recording medium to fix the toner image on the recording medium as the semi-permanently fixed full-color toner image.

Thereafter, the recording medium bearing the fixed toner image is conveyed to the output roller pair 43. The output roller pair 43 discharges the recording medium bearing the fixed toner image onto the output tray, thus completing a series of image forming processes.

Figure 4:
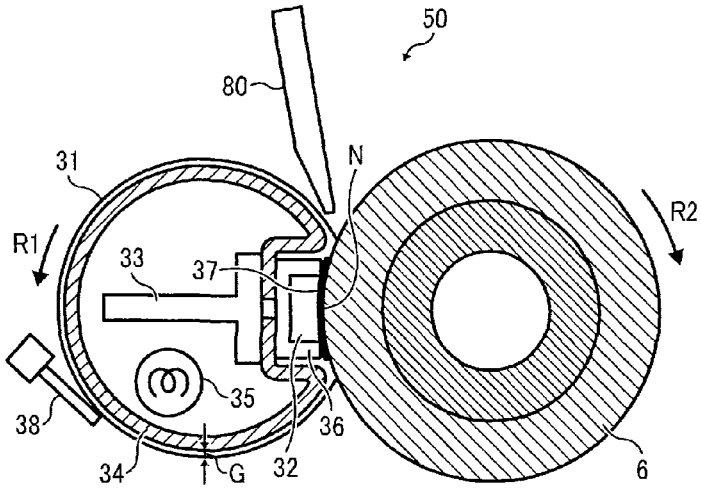
FIG. 4 is a vertical sectional view of a fixing device included in the image forming apparatus shown in FIG. 3.
Figure 5:
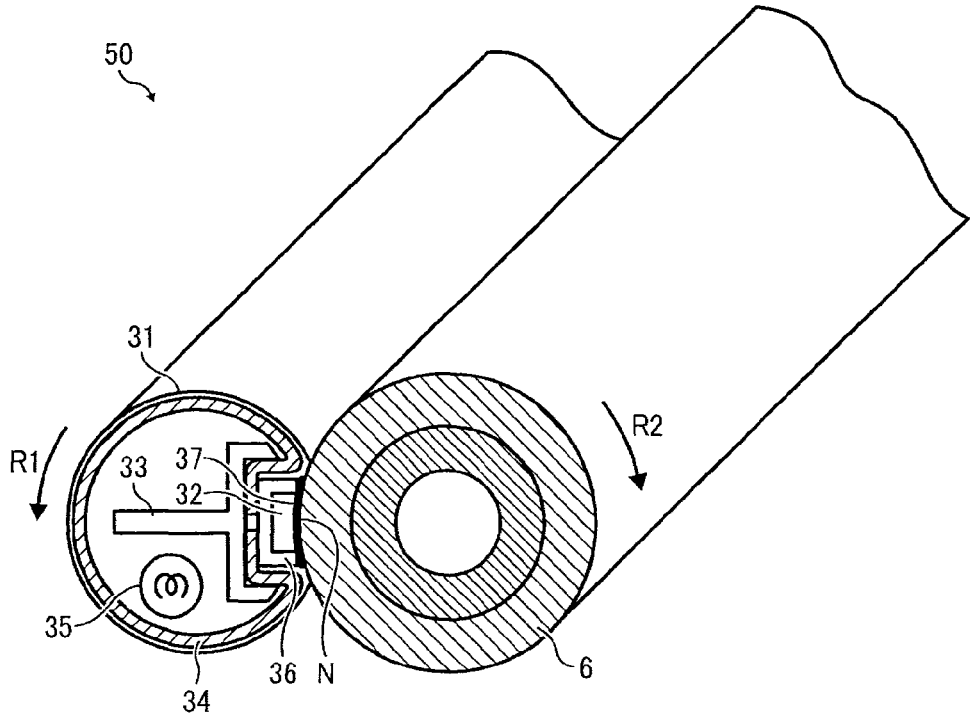
FIG. 5 is a perspective view of the fixing device shown in FIG. 4.

Referring to FIGS. 4 and 5, the following describes the structure and operation of the fixing device 50. FIG. 4 is a vertical sectional view of the fixing device 50. FIG. 5 is a perspective view of the fixing device 50. As illustrated in FIG. 4, the fixing device 50 includes a fixing belt 31 formed into a loop, a pressing roller 6 disposed opposite the fixing belt 31, a nip formation member 32, a support member 33, a metal heat conductor 34, a heater 35, a heat insulator 36, and a mesh-like lubrication sheet 37, which are provided inside the loop formed by the fixing belt 31, and a thermistor 38 provided outside the loop formed by the fixing belt 31.

The fixing belt 31 is a flexible endless belt serving as a fixing member that applies heat to a recording medium. According to this exemplary embodiment, the fixing belt 31 serves as a fixing member. Alternatively, instead of the fixing belt 31, an endless film may be used as the fixing member. The metal heat conductor 34 has a pipe shape or a hollow cylindrical shape, and is provided inside the loop formed by the fixing belt 31 in such a manner that the metal heat conductor 34 faces an inner circumferential surface of the fixing belt 31. For example, the metal heat conductor 34 is fixedly mounted close to the inner circumferential surface of the fixing belt 31 in a state in which the metal heat conductor 34 is not rotatable. The heater 35 (e.g., a halogen heater) is provided inside the hollow cylinder of the metal heat conductor 34, and heats the metal heat conductor 34. The pressing roller 6, serving as a pressing member, is pressed against the nip formation member 32 via the fixing belt 31 to form a fixing nip N between the pressing roller 6 and the fixing belt 31. With this configuration, the fixing belt 31 is heated by heat transmitted from the metal heat conductor 34 heated by the heater 35, and slides over an outer circumferential surface of the metal heat conductor 34 fixedly mounted inside the loop formed by the fixing belt 31 in accordance with rotation of the pressing roller 6. In other words, the fixing belt 31 is rotated by the rotating pressing roller 6.

The nip formation member 32 (e.g., a pad) is provided inside the loop formed by the fixing belt 31 in such a manner that the nip formation member 32 is provided between the metal heat conductor 34 and the fixing belt 31, and is pressed against the pressing roller 6 via the fixing belt 31 to form the fixing nip N between the fixing belt 31 and the pressing roller 6. The nip formation member 32 is supported by the metal heat conductor 34 via the heat insulator 36 that insulates the nip formation member 32 from heat held by the metal heat conductor 34 to improve heating efficiency of the metal heat conductor 34 for heating the fixing belt 31.

The support member 33 is fixedly mounted inside the hollow cylinder of the metal heat conductor 34, and supports a concave portion of the metal heat conductor 34 which supports the nip formation member 32. A lubricant (e.g., silicon oil or fluorine grease) is applied between the metal heat conductor 34 and the fixing belt 31 to decrease friction generated between the fixing belt 31 and the metal heat conductor 34 as the rotating fixing belt 31 slides over the outer circumferential surface of the metal heat conductor 34 fixedly mounted inside the fixing belt 31.

Optionally, the mesh-like lubrication sheet 37 may be provided between the nip formation member 32 and the fixing belt 31 to decrease friction generated between the nip formation member 32 and the fixing belt 31 at the fixing nip N.

The hollow pipe-shaped metal heat conductor 34 is manufactured by bending a thin sheet of metal (hereinafter "sheet metal") such as aluminum, iron, or stainless steel into a generally cylindrical shape. For example, the metal heat conductor 34 has a thickness in a range of from about 0.1 mm to about 0.4 mm. The metal heat conductor 34 has substantially a circular shape in cross-section except for the concave portion of the metal heat conductor 34, which houses the nip formation member 32. However, the shape of the metal heat conductor 34 in cross-section is not limited thereto, and alternatively, the metal heat conductor 34 may have another shape in cross-section, such as an oval shape or a polygonal shape, provided that it retains the generally looped form of the fixing belt 31 while allowing the fixing belt 31 to rotate without significant friction.

The heater 35 provided inside the hollow, pipe-shaped or cylindrical metal heat conductor 34 heats the metal heat conductor 34. Heat diffused from the metal heat conductor 34 heated by the heater 35 is transmitted to the entire fixing belt 31 substantially uniformly so that a surface temperature of the fixing belt 31 is increased to a desired fixing temperature. A rate or power for turning on the heater 35 is controlled based on an output of a temperature sensor (e.g., the thermistor 38) to adjust or maintain the surface temperature of the fixing belt 31.

According to this exemplary embodiment, the heater 35 is a halogen heater provided inside the metal heat conductor 34. Alternatively, an induction heater, a resistance heat generator, or a carbon heater may be used as the heater 35. Further, when the support member 33 is configured to receive radiation heat generated by the heater 35, the support member 33 may include a heat insulation layer as a surface layer or may be mirror-finished to reflect radiation heat of the heater 35. Thus, the processing performed on the surface of the support member 33 prevents temperature increase of the support member 33 and reduces wasteful energy consumption.

FIGS. 4 and 5 illustrate the fixing nip N having a concave shape that faces the pressing roller 6. Alternatively, the fixing nip N may have a planar shape or other shape. However, when the fixing nip N has the concave shape, a leading edge of a recording medium (e.g., a recording sheet) discharged from the fixing nip N is directed to the pressing roller 6, thus facilitating separation of the recording medium from the fixing belt 31 and thereby preventing jamming of the recording medium at the fixing nip N.

The fixing belt 31 is a flexible endless belt having a thickness not greater than about 1 mm, and is constructed of a base layer and a release layer provided on the base layer. The base layer is made of a metal material such as nickel and SUS stainless steel or a resin material such as polyimide. The release layer is made of tetrafluoroethylene perfluoroalkylvinylether copolymer (PFA) and/or polytetrafluoroethylene (PTFE), and is coated on the base layer to provide a separation property for preventing a toner image on the recording medium from adhering to the fixing belt 31. Optionally, an elastic layer made of silicon rubber may be provided between the base layer and the release layer, but is not essential. The fixing belt 31 without the elastic layer has a smaller heat capacity that improves fixing property. However, when the fixing belt 31 and the pressing roller 6 apply pressure to a recording medium bearing an unfixed toner image to fix the toner image on the recording medium, slight surface asperities on an outer circumferential surface of the fixing belt 31 are transferred onto the toner image, roughening the solid toner image into an orange-peel image. To address this problem, the elastic layer made of silicon rubber and having a thickness not smaller than about 100 μm may be preferably provided so that the elastic layer is deformed to absorb slight surface asperities of the fixing belt 31 so as to suppress formation of the orange-peel image.

The pressing roller 6 is constructed of a hollow metal roller, a silicon rubber layer provided on the metal roller, and a release layer provided on the silicon rubber layer as a surface layer. The release layer is made of PFA or PTFE, and provides separation of the recording medium from the pressing roller 6. The pressing roller 6 receives a driving force transmitted from a driver (e.g., a motor) provided in the image forming apparatus 100 depicted in FIG. 3 via a gear train, and is rotated by the driving force in a rotation direction R2. A biasing member (e.g., a spring) applies a bias to the pressing roller 6 to bias the pressing roller 6 against the nip formation member 32 via the fixing belt 31. The silicon rubber layer of the pressing roller 6 deformed by the bias provides a predetermined nip length of the fixing nip N in the recording medium conveyance direction. Accordingly, when the pressing roller 6 pressed against the nip formation member 32 via the fixing belt 31 rotates in the rotation direction R2, the fixing belt 31 pressed by the pressing roller 6 at the fixing nip N rotates in a rotation direction R1 in accordance with rotation of the pressing roller 6, and slides over the outer circumferential surface of the metal heat conductor 34 fixedly mounted inside the fixing belt 31.

Alternatively, the pressing roller 6 may be a solid roller. However, the hollow pressing roller 6 has a desired smaller heat capacity. Optionally, a heater (e.g., a halogen heater) may be provided inside the hollow pressing roller 6. The silicon rubber layer of the pressing roller 6 may be made of solid rubber. Alternatively, when no heater is provided inside the pressing roller 6, the pressing roller 6 may be made of sponge rubber that can improve heat insulation to suppress heat transmission from the fixing belt 31 to the pressing roller 6.

In the fixing device 50 having the above-described structure, the fixing belt 31 rotates and slides over the outer circumferential surface of the metal heat conductor 34 in accordance with rotation of the pressing roller 6. The fixing belt 31 is guided by the metal heat conductor 34 at a position other than the fixing nip N in such a manner that the fixing belt 31 is isolated from the metal heat conductor 34 with a predetermined distance G therebetween. Accordingly, heat is diffused from the metal heat conductor 34 heated by the heater 35 toward the fixing belt 31 to uniformly heat the entire fixing belt 31 isolated from the metal heat conductor 34 by the predetermined distance G. Consequently, the entire fixing belt 31 is heated quickly, stabilizing operation of the fixing device 50.

While the pressing roller 6 rotates in the rotation direction R2, the pressing roller 6 presses the fixing belt 31 against the metal heat conductor 34 via the nip formation member 32 at the fixing nip N. However, in order to cause the fixing belt 31 to slide over the outer circumferential surface of the metal heat conductor 34 smoothly, an inner diameter of the loop formed by the fixing belt 31 needs to be greater than an outer diameter of the metal heat conductor 34. In other words, clearance is required between the inner circumferential surface of the fixing belt 31 and the outer circumferential surface of the metal heat conductor 34 in a diametrical direction of the fixing belt 31.

Figure 6:
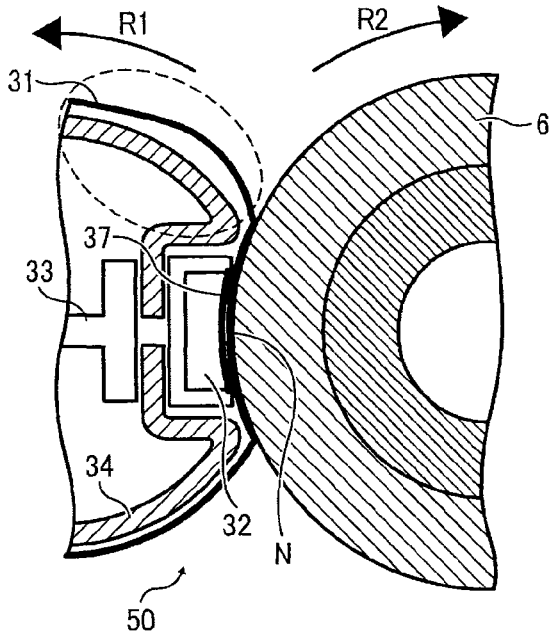
FIG. 6 is a partially enlarged sectional view of the fixing device shown in FIG. 4.

FIG. 6 is a partially enlarged sectional view of the fixing device 50. When the fixing belt 31 rotates in the rotation direction R1 and the pressing roller 6 rotates in the rotation direction R2, the pressing roller 6 applies tension that pulls the fixing belt 31 to the fixing nip N to an upstream portion of the fixing belt 31 provided upstream from the fixing nip N in the rotation direction R1 of the fixing belt 31. Accordingly, the upstream portion of the fixing belt 31 is pressed against the metal heat conductor 34, and therefore the upstream portion of the fixing belt 31 is not slackened but remains taut. By contrast, the pressing roller 6 does not apply tension to a downstream portion of the fixing belt 31 provided downstream from the fixing nip N in the rotation direction R1 of the fixing belt 31. Accordingly, the downstream portion of the fixing belt 31 is not pressed against the metal heat conductor 34, and therefore the downstream portion of the fixing belt 31 goes slack in an area indicated by a broken-line oval in FIG. 6. Moreover, tension applied by the pressing roller 6 to the fixing belt 31, which presses the fixing belt 31 against the metal heat conductor 34 at an upstream position upstream from the fixing nip N in the rotation direction R1 of the fixing belt 31 and at the fixing nip N, facilitates slack of the fixing belt 31.

When the downstream portion of the fixing belt 31 goes slack, the recording medium bearing the fixed toner image, which is discharged from the fixing nip N, is conveyed along the slackened fixing belt 31 in a state in which the recording medium contacts the slackened fixing belt 31. Accordingly, the recording medium bearing the fixed toner image receives an excessive amount of heat from the heated fixing belt 31, generating hot offset of the toner image. Moreover, when the fixing belt 31 goes slack, the recording medium bearing the fixed toner image does not separate from the fixing belt 31 easily. For example, the fixing belt 31 cannot separate the recording medium from the fixing belt 31 by its curvature. Accordingly, the recording medium gets wound around the fixing belt 31 and is jammed.

Figure 7:
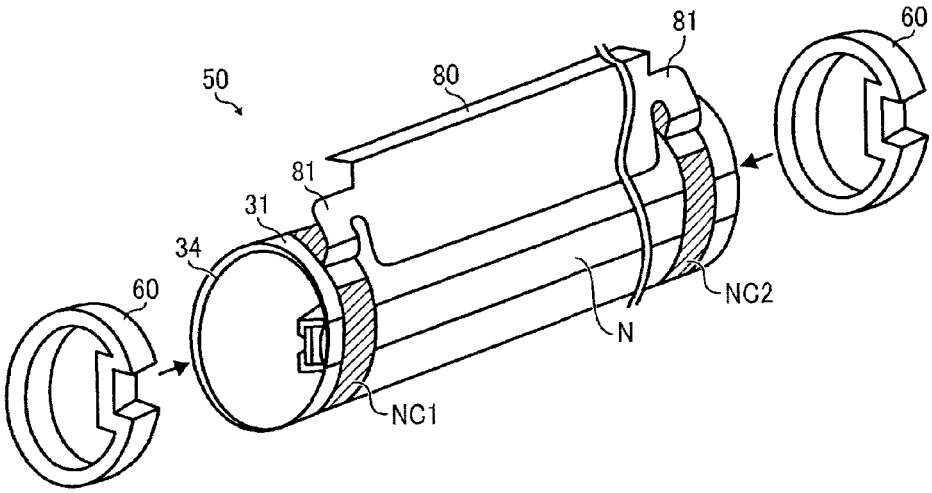
FIG. 7 is a partial perspective view of the fixing device shown in FIG. 5 illustrating a separator and a reinforcement member.

To address these problems, the fixing device 50 according to this exemplary embodiment includes a separator 80 as illustrated in FIG. 7. FIG. 7 is a partial perspective view of the fixing device 50. The separator 80 includes a pressing portion 81. Further, as illustrated in FIG. 7, the fixing device 50 includes a reinforcement member 60. In FIG. 7, the pressing roller 6, the support member 33, and the heater 35 are omitted.

The separator 80 is provided at a position downstream from the fixing nip N in the rotation direction R1 of the fixing belt 31 depicted in FIG. 4, at which the fixing belt 31 is subject to slack as illustrated in FIG. 6. The separator 80 separates the recording medium bearing the fixed toner image, which is discharged from the fixing nip N, from the fixing belt 31, and guides the recording medium to a conveyance path that leads to the output roller pair 43 depicted in FIG. 3. The separator 80 also presses the fixing belt 31 against the metal heat conductor 34 at the position downstream from the fixing nip N in the rotation direction R1 of the fixing belt 31.

The separator 80 is made of sheet metal, in such a manner that a leading edge of the sheet metal that faces the fixing nip N has a thickness in a range of from about 0.1 mm to about 0.3 mm. The separator 80 contacts the recording medium to separate the recording medium discharged from the fixing nip N from the fixing belt 31 and guide the recording medium to the conveyance path that leads to the output roller pair 43 so as to facilitate conveyance of the recording medium. The pressing portions 81 are provided at lateral ends of the separator 80 in a longitudinal direction of the separator 80 parallel to an axial direction of the fixing belt 31, respectively. FIG. 7 illustrates one of the pressing portions 81 provided at one of the lateral ends of the separator 80, and another one of the pressing portions 81 provided at another one of the lateral ends of the separator 80 is omitted. The pressing portions 81 are pressed against the metal heat conductor 34 via the fixing belt 31 so that the pressing portions 81 press the fixing belt 31 against the metal heat conductor 34. Accordingly, the flexible fixing belt 31, which rotates in accordance with rotation of the pressing roller 6, slides over the outer circumferential surface of the metal heat conductor 34 at least before the fixing belt 31 passes the pressing portions 81 in the rotation direction R1 of the fixing belt 31. Thus, the separator 80 prevents slackening of the fixing belt 31 at a position downstream from the fixing nip N in the rotation direction R1 of the fixing belt 31. Further, the separator 80 separates the recording medium discharged from the fixing nip N from the fixing belt 31 while at the same time guiding the recording medium to the conveyance path that leads to the output roller pair 43. Accordingly, the recording medium does not contact the slackened fixing belt 31 for a longer time, preventing hot offset of the toner image on the recording medium. Moreover, the recording medium is not wound around the fixing belt 31, and therefore is not jammed.

According to this exemplary embodiment, the separator 80 is made of sheet metal. Alternatively, the separator 80 may be manufactured by molding a resin material. However, when the resin material is used, the resin material is curled during a molding process and is deformed during a heating process, decreasing dimensional accuracy. Moreover, the leading edge of the separator 80 facing the fixing nip N is not thinned easily with the resin material. Therefore, sheet metal is preferably used. For example, when the sheet metal is processed into the separator 80, the leading edge of the separator 80 can be made thinner. Accordingly, the separator 80 having the thinner leading edge provides improved separation of the recording medium from the fixing belt 31, and is disposed closer to the downstream portion of the fixing belt 31 provided downstream from the fixing nip N in the rotation direction R1 of the fixing belt 31.

In the image forming apparatus 100 depicted in FIG. 3 in which the recording medium is conveyed vertically through the fixing device 50, the downstream portion of the fixing belt 31 in the rotation direction R1 of the fixing belt 31 is provided above the metal heat conductor 34. Accordingly, the separator 80 can press the fixing belt 31 against the metal heat conductor 34 by its weight. Alternatively, a biasing member (e.g., a spring) may apply a bias to the separator 80 to cause the separator 80 (e.g., the pressing portions 81) to press the fixing belt 31 against the metal heat conductor 34 to prevent slackening of the fixing belt 31. Further, according to this exemplary embodiment, the pressing portions 81 are provided at the lateral ends of the separator 80 in the longitudinal direction of the separator 80, respectively. Alternatively, a single pressing portion 81 may be provided at a center of the separator 80 which extends in the longitudinal direction of the separator 80 substantially equivalent to a predetermined width of the metal heat conductor 34 in a longitudinal direction of the metal heat conductor 34 parallel to the axial direction of the fixing belt 31. Yet alternatively, the pressing portion 81 may extend the entire width of the metal heat conductor 34 in the longitudinal direction of the metal heat conductor 34. In other words, the pressing portion 81 may extend through the entire width of the separator 80 in the longitudinal direction of the separator 80 substantially equivalent to the entire width of the metal heat conductor 34 in the longitudinal direction of the metal heat conductor 34.

However, when the pressing portions 81 of the separator 80 press only lateral ends of the fixing belt 31 in the axial direction of the fixing belt 31 against the metal heat conductor 34 as illustrated in FIG. 7, that is, when the pressing portions 81 press only non-conveyance regions NC1 and NC2 provided at the lateral ends of the fixing belt 31 in the axial direction of the fixing belt 31, through which the recording medium does not pass, the separator 80 does not damage a conveyance region of the fixing belt 31 provided at a center of the fixing belt 31 in the axial direction of the fixing belt 31, through which the recording medium passes. In other words, the pressing portions 81 do not press the recording medium bearing the toner image against the fixing belt 31, and therefore do not damage the toner image on the recording medium.

Generally, the fixing devices including the fixing belt or the fixing film and the metal heat conductor provided inside the fixing belt or the fixing film, like the fixing device 50 according to this exemplary embodiment, are designed to use components having a smaller heat capacity to shorten a warm-up time of the fixing devices. Accordingly, the metal heat conductor 34 has a relatively smaller thickness in a range of from about 0.1 mm to about 0.4 mm, and therefore has a smaller strength. Consequently, when the biasing member applies a bias to the separator 80 to cause the separator 80 to press the fixing belt 31 against the metal heat conductor 34, the metal heat conductor 34 may be deformed over time.

To address this problem, the fixing device 50 may include the reinforcement member 60, which reinforces the metal heat conductor 34, provided at each lateral end of the metal heat conductor 34 in the longitudinal direction thereof. The reinforcement member 60 is provided inside the hollow cylinder of the metal heat conductor 34 in a circumferential region in which the pressing portion 81 of the separator 80 presses the fixing belt 31 against the metal heat conductor 34. Specifically, an outer circumferential surface of the reinforcement member 60 faces or contacts interior walls of the metal heat conductor 34 corresponding to a hatched circumferential region of the fixing belt 31 in FIG. 7. FIG. 7 illustrates the reinforcement member 60 before being attached to the metal heat conductor 34. The reinforcement member 60 is inserted into the hollow cylinder of the metal heat conductor 34 and is disposed at the position at which the outer circumferential surface of the reinforcement member 60 faces or contacts the interior walls of the metal heat conductor 34 in the hatched region of the fixing belt 31 in FIG. 7. Further, the reinforcement member 60 is required to resist pressure applied by the pressing portion 81 of the separator 80. Accordingly, the reinforcement member 60 has an outer diameter substantially equivalent to an inner diameter of the metal heat conductor 34. Moreover, when the nip formation member 32 is configured to be inside the fixing belt 31, the reinforcement member 60 includes a concave portion corresponding to the concave portion of the metal heat conductor 34 that houses the nip formation member 32, so that exterior walls of the reinforcement member 60 are shaped to fit the interior walls of the metal heat conductor 34.

In the fixing device 50 depicted in FIG. 7, the reinforcement member 60 is inserted into the metal heat conductor 34. Alternatively, the reinforcement member 60 may be provided outside the metal heat conductor 34. For example, the reinforcement member 60 is attached to the outer circumferential surface of the metal heat conductor 34 in the circumferential region of the metal heat conductor 34 corresponding to the hatched circumferential region of the fixing belt 31 in FIG. 7 in a state in which an inner diameter of the reinforcement member 60 is equivalent to the outer diameter of the metal heat conductor 34. Further, interior walls of the reinforcement member 60 are designed to fit exterior walls of the metal heat conductor 34. Specifically, the reinforcement member 60 is formed of a thin member so that the outer circumferential surface of the metal heat conductor 34 is disposed close to the inner circumferential surface of the fixing belt 31. Further, the reinforcement member 60 is isolated from the conveyance region of the fixing belt 31 through which the recording medium passes as far as possible. Yet alternatively, the two reinforcement members 60 may be used to reinforce the metal heat conductor 34 by attaching the two reinforcement members 60 to the interior walls and the exterior walls of the metal heat conductor 34, respectively, at each lateral end of the metal heat conductor 34 in the longitudinal direction thereof.

Figure 8:
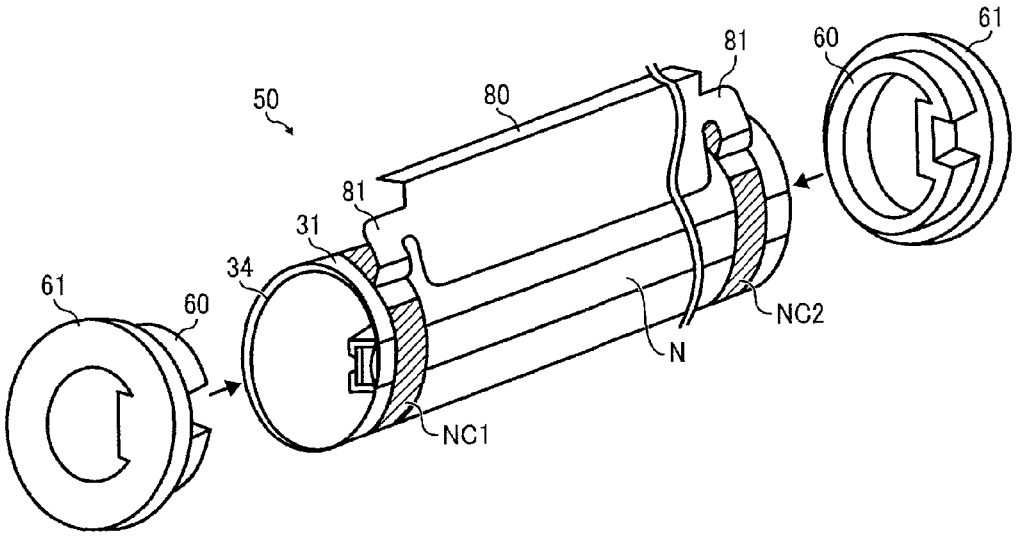
FIG. 8 is a partial perspective view of the fixing device shown in FIG. 5 illustrating a flange.
Figure 9:
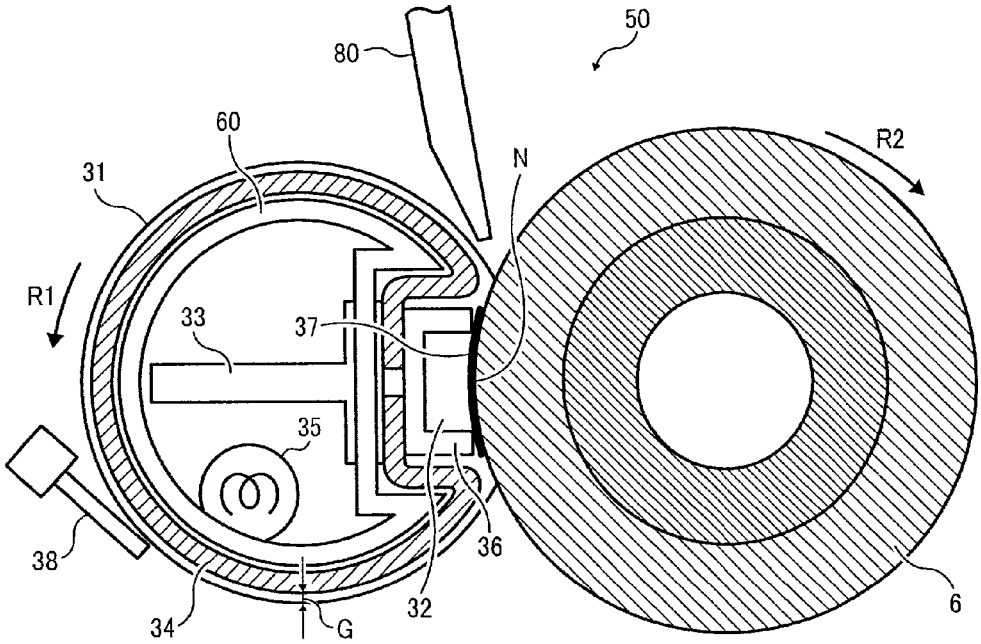
FIG. 9 is a sectional view showing the reinforcement members inside the heat conductor.
Figure 10:
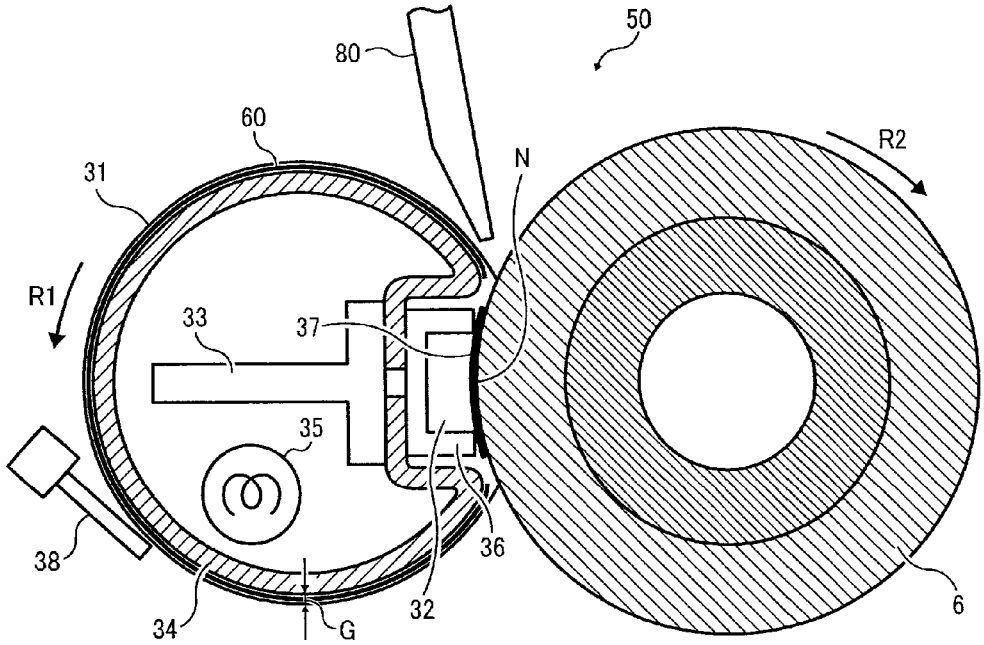
FIG. 10 is a sectional view showing the reinforcement members outside the heat conductor.
Figure 11:
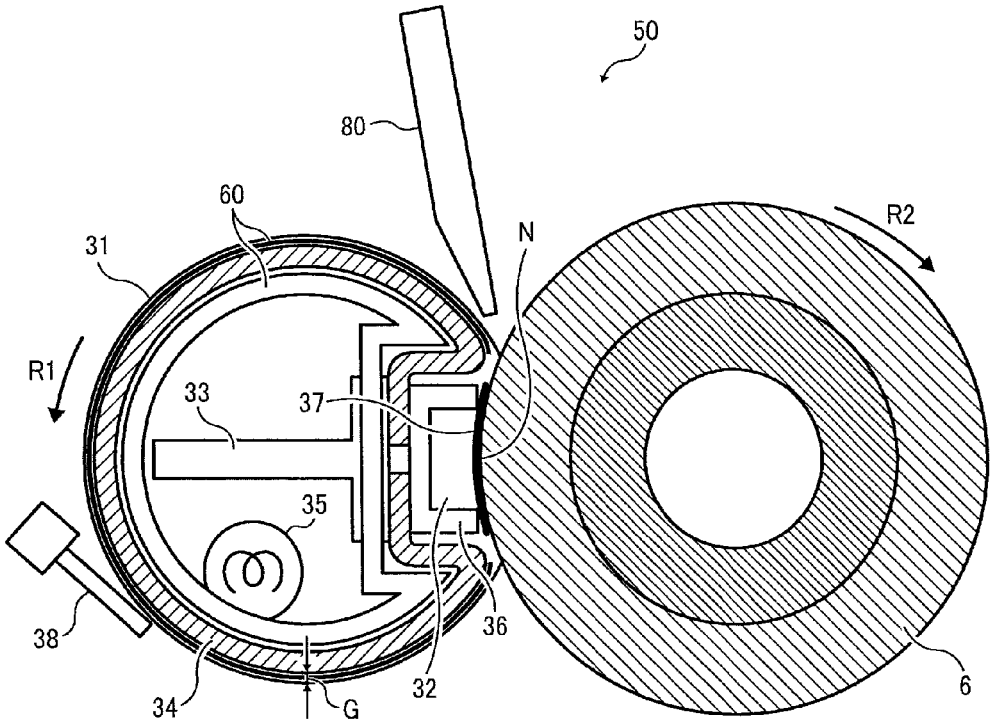
FIG. 11 is a sectional view showing the sandwiching of the heat conductor by the reinforcement members.

Referring to FIG. 8, the following describes another structure for reinforcing the metal heat conductor 34. FIG. 8 is a partial perspective view of the fixing device 50 including a flange 61 that reinforces the metal heat conductor 34 at each lateral end of the metal heat conductor 34 in the longitudinal direction thereof.

The flange 61 is attached to the reinforcement member 60 and serves as an attachment member that attaches the reinforcement member 60 to a housing wall of the fixing device 50 or the image forming apparatus 100 depicted in FIG. 3. For example, when the reinforcement member 60 attached with the flange 61 is inserted into the metal heat conductor 34, the flange 61 is mounted on one end of the metal heat conductor 34 in the longitudinal direction of the metal heat conductor 34. Thus, the metal heat conductor 34 is fixed to the housing wall of the fixing device 50 via the reinforcement member 60 and the flange 61. In other words, the metal heat conductor 34 is mounted on the housing wall of the fixing device 50 via the flange 61 attached to the reinforcement member 60 at each lateral end of the metal heat conductor 34 in the longitudinal direction thereof. With this configuration, the metal heat conductor 34 can be reinforced with fewer parts.

Referring to FIGS. 4, 5, 7, and 8, the following describes the effects provided by the fixing device 50. As described above, the separator (e.g., the separator 80) is provided near an exit of the fixing nip (e.g., the fixing nip N), that is, at a position downstream from the fixing nip in the rotation direction R1 of the fixing member (e.g., the fixing belt 31). The separator separates a recording medium discharged from the fixing nip from the fixing member and guides the recording medium out of the fixing device (e.g., the fixing device 50).

The separator also presses the fixing member against the metal heat conductor (e.g., the metal heat conductor 34) at a position near the exit of the fixing nip. Accordingly, the fixing member rotates in a state in which the fixing member contacts the metal heat conductor at least before the fixing member passes the separator, reducing slack of the fixing member which may cause the fixing member to contact the recording medium at the position downstream from the fixing nip in the rotation direction R1 of the fixing member.

Further, the separator presses the fixing member against the metal heat conductor at each of the lateral ends of the fixing member in the axial direction of the fixing member, that is, the non-conveyance regions on the fixing member through which the recording medium does not pass. Accordingly, even if the separator contacting the fixing member scratches or damages the fixing member, the recording medium passes through the center portion of the fixing member in the axial direction of the fixing member, that is, the conveyance region on the fixing member, and therefore does not contact the damaged lateral ends of the fixing member in the axial direction of the fixing member. As a result, a toner image fixed on the recording medium is not damaged by the fixing member.

Moreover, the reinforcement members (e.g., the reinforcement members 60) are provided inside and/or outside the metal heat conductor on the interior walls and/or the exterior walls of the metal heat conductor, respectively, in each circumferential region in which the separator presses the fixing member against the metal heat conductor. Accordingly, the metal heat conductor reinforced by the reinforcement members is not deformed by pressure applied by the separator to the metal heat conductor.

Further, the attachment members (e.g., the flanges 61) can be added to the reinforcement members so that the metal heat conductor is fixed to the housing walls of the fixing device via the reinforcement members and the attachment members mounted on the reinforcement members, respectively. Thus, the fixing device is manufactured at reduced costs with fewer parts.

In the fixing device 50 according to the above-described exemplary embodiments, the pressing roller 6 is used as a pressing member. Alternatively, a pressing belt, a pressing pad, a pressing plate, or the like may be used as a pressing member to provide effects equivalent to the effects provided by the pressing roller 6. Further, the fixing belt 31 is used as a fixing member. Alternatively, an endless fixing sleeve, an endless fixing film, or the like may be used as a fixing member.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a flexible and endless fixing member to rotate in a predetermined direction of rotation, formed into a loop, wherein the fixing member has a thickness of 1 mm or less;

a metal heat conductor provided inside the loop formed by the fixing member and facing an inner circumferential surface of the fixing member;

a pressing member to press the fixing member against the metal heat conductor to form a nip between the fixing member and the pressing member through which a recording medium bearing a toner image passes;

a separator that presses the fixing member against the metal heat conductor, provided downstream from the nip in the direction of rotation of the fixing member and contacting the recording medium discharged from the nip to separate the recording medium from the fixing member and guide the recording medium out of the fixing device, the separator including a first pressing portion provided at one lateral end of the separator in an axial direction of the fixing member, to contact a first non-conveyance region on the fixing member through which the recording medium does not pass, and a second pressing portion provided at another lateral end of the separator in the axial direction of the fixing member, to contact a second non-conveyance region on the fixing member through which the recording medium does not pass;

a first reinforcement member to contact and reinforce the metal heat conductor, the first reinforcement member positioned within the metal heat conductor in a first circumferential region of the metal heat conductor which corresponds to the first non-conveyance region on the fixing member through which the recording medium does not pass and that is contacted by the first pressing portion of the separator; and a second reinforcement member to contact and reinforce the metal heat conductor, the second reinforcement member positioned within the metal heat conductor in a second circumferential region of the metal heat conductor which corresponds to the second non-conveyance region on the fixing member through which the recording medium does not pass and that is contacted by the second pressing portion of the separator, wherein a cross section of the fixing member defines a circular shape except for a portion of the fixing member at the nip pressed by the pressing member, the portion of the fixing member at the nip has a concave shape, wherein a cross section of the metal heat conductor defines a circular shape except for a portion of the metal heat conductor at the nip, the portion of the metal heat conductor at the nip has a concave shape, and wherein a cross section of each of the first and second reinforcement members defines a circular shape except for a portion of the first and second reinforcement members at the nip, the portion of the first and second reinforcement members at the nip has a concave shape.

2. The fixing device according to claim 1, wherein the metal heat conductor is fixedly mounted inside the loop formed by the fixing member and the pressing member rotates the fixing member in the predetermined direction of rotation to cause the fixing member to slide over an outer circumferential surface of the stationary metal heat conductor.

3. The fixing device according to claim 1, further comprising a heater provided inside the substantially cylindrical metal heat conductor to heat the metal heat conductor, wherein the metal heat conductor conducts heat received from the heater to the fixing member.

4. The fixing device according to claim 1, wherein the first reinforcement member and the second reinforcement member are provided inside the substantially cylindrical metal heat conductor to contact interior walls of the metal heat conductor.

5. The fixing device according to claim 1, wherein the first reinforcement member and the second reinforcement member are provided outside the substantially cylindrical metal heat conductor to contact exterior walls of the metal heat conductor.

6. The fixing device according to claim 1, wherein the first reinforcement member and the second reinforcement member sandwich the substantially cylindrical metal heat conductor both inside and outside the substantially cylindrical metal heat conductor.

7. The fixing device according to claim 1, wherein the first reinforcement member includes a first attachment member mounted thereon and the second reinforcement member includes a second attachment member mounted thereon, and wherein the first attachment member and the second attachment member are attached to lateral ends of the metal heat conductor in the axial direction of the fixing member, respectively, to support the metal heat conductor inside the fixing device.

8. The fixing device according to claim 7, wherein the first attachment member and the second attachment member are mounted on housing walls of the fixing device, respectively.

9. An image forming apparatus comprising the fixing device according to claim 1.

10. The fixing device according to claim 1, wherein the first reinforcement member contacts and reinforces the metal heat conductor directly in the first circumferential region of the metal heat conductor, and the second reinforcement member contacts and reinforces the metal heat conductor directly in the second circumferential region of the metal heat conductor.

11. The fixing device according to claim 1, wherein the entire thickness of the concave portion of the fixing member at the nip extends toward an interior of the fixing member when pressed by the pressing member.

* * * * *